US005179236A

United States Patent [19]

Shimotori et al.

[11] Patent Number: 5,179,236

[45] Date of Patent: Jan. 12, 1993

[54] SPEED GOVERNOR FOR MUSIC BOX OR THE LIKE

[75] Inventors: Yasuzo Shimotori; Katsuhiko Ushiyama, both of Nagano, Japan

[73] Assignee: K.K. Sankyo Seiki Seisakusho, Nagano, Japan

[21] Appl. No.: 656,341

[22] Filed: Feb. 15, 1991

[30] Foreign Application Priority Data

Feb. 23, 1990 [JP] Japan ..... 2-17685[U]

[51] Int. Cl.[5] ..... G10F 1/06

[52] U.S. Cl. ..... 84/95.1

[58] Field of Search ..... 84/94.1, 95.1, 96

[56] References Cited

U.S. PATENT DOCUMENTS 4,458,573 7/1984 Isaka ..... 84/95.1

4,464,969 8/1984 Isaka et al. ..... 84/95.1

FOREIGN PATENT DOCUMENTS 59-53398 4/1984 Japan .

60-8999 1/1985 Japan .

2108713 8/1982 United Kingdom .

*Primary Examiner*—Michael L. Gellner

*Assistant Examiner*—Cassandra C. Spyrou

*Attorney, Agent, or Firm*—Sughrue, Mion, Zinn, Macpeak & Seas

[57] ABSTRACT

A speed governor for a music box driven by an energized spring includes a worm wheel operatively connected to and driven by the energized spring; a worm shaft driven by the worm wheel; a rotary member connected to the shaft and driven by the wheel and having a top, a bottom and at least one peripheral surface, the member including a plurality of coupling portions connected to the shaft, which are elastically deformed due to rotation, each of the coupling portions having at least one groove and being disposed so that at least one of the top and the bottom surfaces of each of the coupling portions is located substantially parallel to but not coincident with an imaginary plane containing the center of gravity of the member located perpendicular to the shaft: and a brake portion provided near one of the top, the bottom or peripheral surface of the member so as to be rubbed by one of the top, the bottom or peripheral surface when the rotational speed of the rotary member is greater than or equal to a predetermined speed.

16 Claims, 1 Drawing Sheet

SPEED GOVERNOR FOR MUSIC BOX OR THE LIKE

FIELD OF THE INVENTION

The present invention relates to a speed governor for a music box or the like.

BACKGROUND OF THE INVENTION

Speed governors for a music box or the like are disclosed in exemplary U.S. Pat. Nos. 4,458,573 and 4,464,969. The speed governor is briefly described below while referring to FIG. 6, where a rotary member 61 made of an elastically deformable material such as rubber is provided on a rotatably supported worm shaft 60. It includes weight portions 61*a* and arm portions 61*b* coupling the weight portions 61*a* to the central portion of the rotary member 61. The worm shaft 60 is rotated by a worm wheel 62, which is the final member of a gear train connected to the drum of the music box or the like, which is not shown in FIG. 6. An annular brake member 63 is provided opposing the top of the rotary member 61. When the rotational speed of the worm shaft 60 being rotated by the worm wheel 62 has exceeded a prescribed value, the weight portions 61*a* of the rotary member 61 elastically deform the arm portions 61*b* thereof due to the centrifugal force thereon so that the arm portions 61*b* are moved to positions shown by dotted lines in FIG. 6. The friction surfaces 61*c* of the arm positions 61*b* rub the brake member 63 to create a frictional resistance to brake the rotation of the worm shaft 60 and the worm wheel 62, thus keeping the rotational speed of the drum at the prescribed value.

The speed governor disclosed in the U.S. Patents mentioned above utilizes both air resistance and frictional resistance, and has a feature that the governor is capable of securely controlling the speed of the drum of the music box or the like and is single in construction.

When the time (the playing time of the music box or the like) required to rotate the drum thereof by one revolution is to be lengthened, either the air resistance and the frictional resistance are increased or the distance G between the friction surface 61*c* of each arm portion (61*b* of the rotary member 61) and the brake member 63 in the stopped state of the speed governor is reduced by altering the press-fit location of the rotary member 61 on the worm shaft 60. However, increasing the air resistance and the frictional resistance creates a problem in that the number of components processed or adjusted for the increased rotational time is large, which makes the work of increasing the rotational time inefficient and makes the cost thereof high. Also, reducing the distance G creates additional problems in that adjustment of the press-fitting equipment for adjusting the final location of the rotary member 61 is time-consuming, which makes the cost of reducing the air gap G high. In addition, the effect of adjustment of the air gap on the rotation time does not produce consistent results, which makes the initial value of the time of every single revolution of the rotation of the drum irregular.

SUMMARY OF THE INVENTION

The present invention was made in order to solve these problems. Accordingly, it is an object of the present invention to provide a speed governor for a music box, or the like, in which the initial value of the time of every single revolution of the rotation of the drum of the music box, or the like is, made consistent so as to improve the quality of the speed governor while lowering the cost of manufacture.

The speed governor provided in accordance with the present invention is for a music box or the like which is driven by the release force of an energized spring. The speed governor is characterized in that it comprises a worm wheel, a worm shaft, a rotary member and a brake portion wherein the worm wheel is driven by a gear train whose speed is controlled by the speed governor; the worm shaft is rotated by the worm wheel; the rotary member includes coupling portions connected to the worm shaft so as to be elastically deformed; the brake portion is provided near one of the top, bottom and peripheral surfaces of the rotary member so as to be rubbed by a part of the rotary member; and the coupling portions have grooves and each of the coupling portions has ends one of which is offset in the axial direction of the worm shaft, from an imaginary plane containing the center of gravity of the rotary member and perpendicular to the worm shaft.

BRIEF DESCRIPTION OF THE DRAWINGS

The preferred embodiments are described with reference to the drawings, in which.

DESCRIPTION OF THE PREFERRED EMBODIMENTS

An embodiment of the present invention is hereafter described in detail with reference to the drawings attached hereto.

Figure 1:
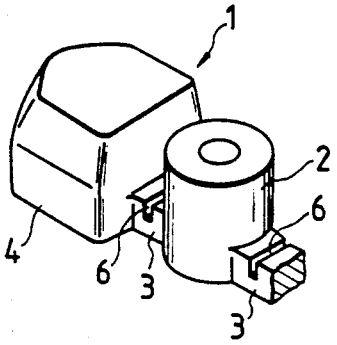
FIG. 1 is a perspective view of part of the rotary member of a speed governor according to the preferred embodiment of the present invention.
Figure 2:
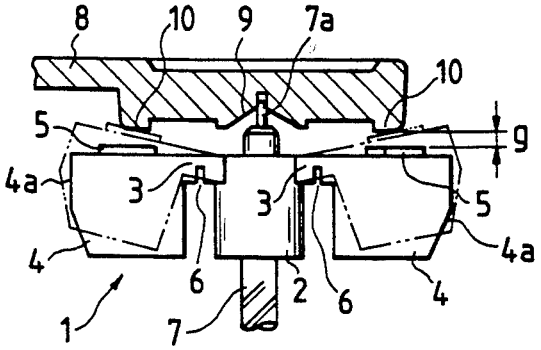
FIG. 2 is a front view of the speed governor according to the preferred embodiment of the present invention.
Figure 3:
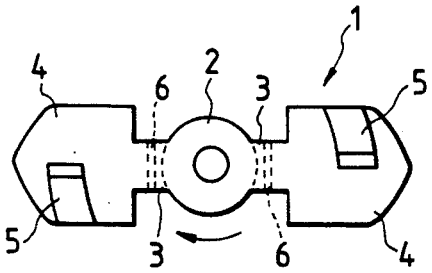
FIG. 3 is a plan view of the rotary member shown in FIG. 2.
Figure 5A:
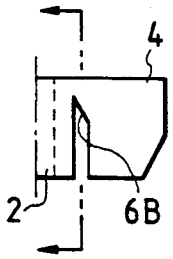
FIGS. 5*a* and 5*b* are front and sectional views, respectively, of another modified embodiment of major parts of rotary member shown in FIG. 2.
Figure 5B:
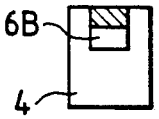

FIGS. 1, 2 and 3 show a speed governor according to the preferred embodiment of the present invention. The speed governor has a rotary member 1 made of rubber or the like and including a base portion 2 press-fitted on a worm shaft 7, and a plurality weight portions 4 coupled to the boss portion by corresponding coupling portions 3. Each of the weight portions 4 has a predetermined mass. A rubbing surface 5 is provided on the top of each weight portion 4, and slightly projects therefrom. In the axial direction of the worm shaft 7, the coupling portions 3 are located substantially parallel to but not coincident with an imaginary plane containing the centers of gravity of the weight portions 4 and perpendicularly intersecting the worm shaft 7, so that the coupling portions couple the weight portions 4 to the boss portion 2 at their upper parts as shown in FIG. 2.

The coupling portions 3 have grooves 6, which are elongated at the time of elastic deformation due to the rotation of the coupling portions 3. The grooves 6 extend substantially in the circumferential direction of the boss portion 2. The grooves 6 are made in the coupling portions 3 when the rotary member 1 is molded in, for example, dyes. It is preferable that the width of each groove 6 is made as small as possible to minimize the sagging of the weight portions 4 during the time that the rotary member 1 is stationary.

The worm shaft 7 is rotatably supported at one end 7*a* thereof by bearing portions 9 of a fixed member 8 having an annular brake portion 10, the center of which is located coincident with the bearing portion 9. The rubbing surfaces 5 on the tops of the weight portions 4 rub the brake portion 10 when the rotary member 1 is rotated.

When the worm wheel 62 of the speed governor provided in accordance with the preferred embodiment of the present invention is driven by the release force of the spring (not shown), the worm shaft 7 is rotated so that the rotary member 1 is elastically deformed at the grooves 6 of the coupling portions 3 due to the centrifugal force produced the rotation of worm shaft 7 and rubs the brake portion 10. The worm shaft 7 is rotated by the worm wheel 62 of a gear train connected to the drum of a music box or the like. The speed of the gear train is in turn controlled by the speed governor. The drum is driven by the release force of a spring such as an energized spiral spring.

Figure 6:
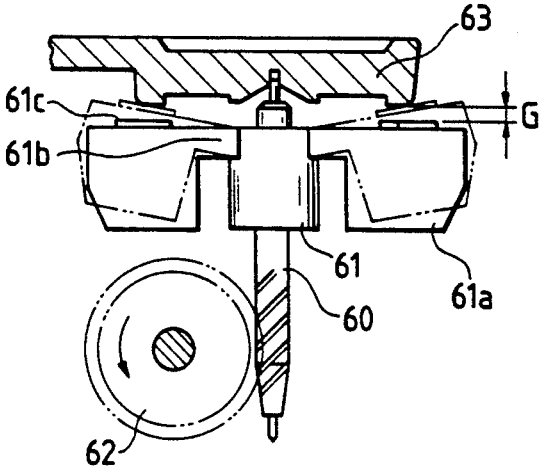
FIG. 6 is a front view of a conventional speed governor.

The rotary member 1 is press-fitted on the worm shaft 7 so that the distance g, which does not need to be smaller than that G in the conventional speed governor shown in FIG. 6, is set between the brake portion 10 and each rubbing surface 5.

When the worm shaft 7 is rotated by the release force of the spring, the rotary member 1 coupled to shaft 7 is also rotated. If the rotation of the worm shaft 7 is rapid, a centrifugal force acts on each weight portion 4 of the rotary member 1 so that, since the coupling portion 3 is located substantially parallel to but not coincident with the above-mentioned imaginary plane in the axial direction of the worm shaft 7, the weight portion 4 is elastically deformed toward the brake portion 10, which causes the rubbing surface 5 to rub the brake portion 10. Because of this rubbing action, a frictional resistance is applied to the worm shaft 7 so that the output force of the spring driving the gear train rotating the worm shaft is set at a fixed level to keep the rotation speed of the drum constant. At that time, the coupling portions 3 are elastically deformed at the grooves 6 thereof.

Since the displacement of the rotary member 1 and the speed of the displacement are larger and higher in the preferred embodiment of the present invention than those of the conventional speed governor shown in FIG. 6, the rubbing surfaces 5 are more likely to come into contact with the brake portion 10. For that reason, the construction of the rotary member 1 is such that the member 1 is more sensitive to the rotation speed of the worm shaft 7. As a result, when the rotation speed of the worm shaft 7 has exceeded a predetermine-d speed, the rotary member 1 quickly comes into rubbing contact with the brake portion 10 to continuously brake the worm shaft, thereby slowly releasing the stored energy of the spring to lengthen the playing time of a music box or the like. Since the gap g does not need to be adjusted as finely as that G of the conventional speed governor, the efficiency of the adjustment work on the speed governor which is the embodiment is higher and a component which is not the rotary member 1 can be used jointly.

Figure 4A:
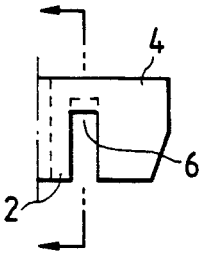
FIGS. 4*a* and 4*b* are front and sectional views, respectively, of a modified embodiment of major parts of the rotary member shown in FIG. 2.
Figure 4B:
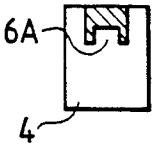

Although the grooves 6 of the coupling portions 3 extend substantially in the circumferential direction of the boss portion 2 in the embodiment described above, the grooves do not need to extend in such a direction to make it easy to elastically deform the coupling portions but may be replaced by grooves 6A and 6B shown in FIGS. 4*a* and 4*b* and 5*a* and 5*b*, respectively. .The groove 6A shown in FIGS. 4*a* and 4*b* extends in the radial direction of the rotary member 1. The depth of the sides of groove 6B, shown in FIGS. 5*a* and 5*b*, changes while traversing grove 6B in a radial direction so that the lengths of the opposing sides are different from one another. Preferably, the grooves 6A and 6B, which are provided for making it easy to elastically deform the coupling portions 3, are made therein by molding. It will be appreciated that, if the grooves are made by a machining operation, such as cutting a flaw, which could result in breaking the coupling portion, it would be difficult to provide components of good quality.

Although the speed governor according to the preferred embodiment of the present invention, described above, is used for controlling the rotation speed of the drum of a music box or the like, the present invention is not confined thereto but may be otherwise embodied as a speed governor for such items as a toy car, a moving toy or the like utilizing the release force of a spring, such as a spiral spring, and can lengthen the working time of the toy or the like. While the rubbing surfaces on the rotary member 1 of the speed governor shown in FIGS. 1, 2 and 3 are put into contact with the brake portion 10 to produce frictional resistance, the present invention is not confined thereto. It may be embodied so that the brake portion is provided in such a position that the parts (for example, the ends 4*a* shown in FIG. 2) of the weight portions 4, which are displaced along with the elastic deformation of the weight portions 4 because the coupling portions are displaced from the imaginary plane in the axial direction of the worm shaft, come into rubbing contact with the brake portion 10.

In a speed governor provided in accordance with the present invention, the release force of a spring can be slowly taken out therefrom through very simple construction to lengthen the working time of a music box or the like. A music box or the like, the working time of which is longer, can be manufactured by altering only the rotary member 1 of the speed governor, namely, without altering the construction of the other members thereof, to provide products of different speeds at lower cost. It contributes to the reduction in the cost of the speed governor and produces speed governors equal to each other in quality. The work required for adjusting the press-fitted position of the rotary member 1 on a worm shaft 7 to change the working time of the governor is not therefore needed and manufacturing costs can be lowered.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. A speed governor for a music box or the like which is driven by release force of an energized spring via a gear train connected to the energized spring, said speed governor comprising:

a worm wheel operatively connected to and driven by the energized spring;

a worm shaft operatively connected to be driven by said wheel;

a rotary member fixedly connected to said shaft so as to be driven by said wheel, said rotary member having a top, a bottom and at least one peripheral surface, said rotary member including a plurality of coupling portions connected to said shaft so as to be elastically deformed, each of said coupling portions having a cross section reduced from an adjacent cross section of said shaft and further having at least one groove, said coupling portions being disposed so that at least one of said top and said bottom surfaces of each of said coupling portions is located substantially parallel to but not coincident with an imaginary plane containing a center of gravity of said member located in the axial direction of said shaft and perpendicular to said shaft; and a brake portion provided near one of said top, said bottom and said at least one peripheral surface of said rotary member to be rubbed by one of said top, said bottom and said at least one peripheral surface when rotational speed of said rotary member is greater than or equal to a predetermined speed.

2. The speed governor according to claim 1, wherein said grooves extend substantially in a direction of rotation of said rotary member.

3. The speed governor according to claim 1, wherein depths of first and second sides of each of said grooves are different from one another.

4. The speed governor according to claim 1, wherein said grooves extend in a radial direction of said rotary member.

5. The speed governor according to claim 4, wherein depths of first and second sides of each of said grooves are different from one another.

6. A speed governor of controlling an operational speed of a shaft driven by an energized spring and supported between a bearing portion of a fixed surface and a drive wheel operatively connected to the energized spring by a gear train, the governor comprising:

a rotary member fixedly coupled to the shaft and including a plurality of weight portions, a boss and a plurality of coupling members, each of said coupling members coupling a corresponding one of said weight portions to said boss and having a corresponding groove; and brake means for braking rotational speed of the shaft due to friction between said brake means and at least one surface of said rotary member when a rotational speed of the shaft is greater than or equal to a predetermined speed;

said coupling members located in a plane substantially parallel to but not coincident with an imaginary plane perpendicular to an axis of the shaft and intersecting a center of gravity of said rotary member, said coupling members and said corresponding grooves cooperatively supporting said weight portions so that at least one surface of said rotary member is substantially parallel to said plane when said rotary member is in a stopped state, and said weight portions elastically deform portions of said coupling member adjacent to said corresponding grooves when said rotational speed is greater than of equal to said predetermined speed.

7. The speed governor according to claim 6, wherein said corresponding grooves extend substantially in a direction of rotation of said rotary member.

8. The speed governor according to claim 6, wherein depths of first and second sides of each of said corresponding grooves are different from one another.

9. The speed governor according to claim 6, wherein said corresponding grooves extend in a radial direction of said rotary member.

10. The speed governor according to claim 9, wherein depths of first and second sides of each of said corresponding grooves are different from one another.

11. A speed governor for controlling a operational speed of a shaft driven by an energized spring and supported between a bearing portion of a fixed surface and a drive wheel operatively connected to the energized spring by a gear train, the governor comprising:

a rotary member fixedly coupled to the shaft and including a plurality of weight portions, a boss and a plurality of coupling members, each of said coupling members coupling a corresponding one of said weight portions to said boss and having a cross section reduced from an adjacent cross section of said boss and further having a corresponding groove; and brake means for braking rotational speed of the shaft due to friction between said brake means and at least one friction surface of said rotary member when a rotational speed of the shaft is greater than or equal to a predetermined speed;

wherein said coupling members and said corresponding grooves cooperatively support said weight portions so that at least one outer surface of said rotary member is substantially parallel to but not coincident with an imaginary plane perpendicular to an axis of the shaft and intersecting a center of gravity of said rotary member when said rotary member is in a stopped state, and said weight portions elastically deform portions of said coupling member adjacent to said corresponding grooves when said rotational speed is greater than of equal to said predetermined speed.

12. The speed governor according to claim 11, wherein said corresponding grooves extend substantially in a direction of rotation of said rotary member.

13. The speed governor according to claim 11, wherein depths of first and second sides of each of said corresponding grooves are different from one another.

14. The speed governor according to claim 11, wherein said corresponding grooves extend in a radial direction of said rotary member.

15. The speed governor according to claim 14, wherein depths of first and second sides of each of said corresponding grooves are different from one another.

16. The speed governor according to claim 11, wherein said at least one friction surface is said at least one outer surface.

* * * * *